US008534163B2

(12) United States Patent
Hoolahan et al.

(10) Patent No.: US 8,534,163 B2
(45) Date of Patent: Sep. 17, 2013

(54) TOOL FOR REMOVING SHEATHING AND DECKING MATERIAL AND THE LIKE

(76) Inventors: Stephen Hoolahan, Massapequa, NY (US); Frank J. Pirnat, Commack, NY (US)

( * ) Notice: Subject to any disclaimer, the term of this patent is extended or adjusted under 35 U.S.C. 154(b) by 796 days.

(21) Appl. No.: 12/587,540

(22) Filed: Oct. 8, 2009

(65) Prior Publication Data

US 2010/0088870 A1 Apr. 15, 2010

Related U.S. Application Data

(60) Provisional application No. 61/195,682, filed on Oct. 9, 2008.

(51) Int. Cl.
*E04D 15/02* (2006.01)

(52) U.S. Cl.
USPC ..... 81/45; 254/131.5

(58) Field of Classification Search
USPC ..... 29/267; 254/131.5, 131; 81/45; 172/378; 16/426; 294/57, 58, 59, 60
See application file for complete search history.

(56) References Cited

U.S. PATENT DOCUMENTS

| | | | | | |
|---|---|---|---|---|---|
| 1,062,474 | A * | 5/1913 | Kelly | 294/54.5 |
| 1,898,234 | A * | 2/1933 | Anderson | 294/54.5 |
| 2,028,483 | A * | 1/1936 | Van Yahres | 294/50.6 |
| 2,047,485 | A * | 7/1936 | McBrady | 294/57 |
| 2,891,813 | A * | 6/1959 | Inaki | 294/50.6 |
| 3,202,120 | A * | 8/1965 | Laffler | 111/96 |
| 3,226,149 | A * | 12/1965 | McJohnson | 294/50 |
| 3,985,338 | A * | 10/1976 | Herrmann | 254/131 |
| 4,198,090 | A * | 4/1980 | Gutman | 294/58 |
| 4,466,188 | A * | 8/1984 | Svendsgaard | 30/172 |
| 5,381,707 | A * | 1/1995 | Gill | 74/546 |
| 5,495,781 | A * | 3/1996 | Wirth | 81/45 |
| 5,645,305 | A * | 7/1997 | Lispi | 294/58 |
| 6,003,915 | A * | 12/1999 | Bierman | 294/51 |
| 8,079,290 | B2 * | 12/2011 | Cox | 81/45 |
| 2007/0199412 | A1 * | 8/2007 | Lee | 81/177.85 |

* cited by examiner

*Primary Examiner* — Joseph J Hail
*Assistant Examiner* — Joel Crandall
(74) *Attorney, Agent, or Firm* — Adams & Wilks

(57) ABSTRACT

A tool for removing sheathing, decking material and the like includes a generally wedge-shaped head and a handle having a base end portion integrally connected to the head and a free end portion projecting rearwardly from a rear end of the head. A fulcrum member removably connects to the head proximate the rear end thereof so as to extend in a direction transverse to the handle to provide a fulcrum during operation of the tool.

20 Claims, 4 Drawing Sheets

TOOL FOR REMOVING SHEATHING AND DECKING MATERIAL AND THE LIKE

CROSS-REFERENCE TO RELATED APPLICATIONS

The present Application for Patent claims priority benefit of Provisional Application Ser. No. 61/195,682, filed Oct. 9, 2008. This provisional patent application is hereby expressly incorporated by reference herein in its entirety.

BACKGROUND OF THE INVENTION

1. Field of the Invention

The present invention relates to construction equipment, and more specifically relates to manual, hand-held tools used in the housing industry for removing sheathing, decking and the like from existing structures.

2. Background Information

For refurbishing existing building structures, very often it is necessary to remove sheathing and decking material from the structure. The sheathing and decking material is usually fastened to and supported by spaced apart joists.

Various tools and devices have been provided for removing old sheathing and decking material preparatory to the installation of new replacement sheathing and shingle material. A common method of removing such sheathing and decking material is to use a crowbar or the like. This is a manually exhaustive and time consuming operation. Furthermore, there is very little mechanical advantage in using a crowbar to remove such sheathing and decking material. Such a conventional method may result in muscle strain or even back injury.

Other removing tools include generally planar work-engaging heads carried by elongated handles which may be manually manipulated to drive the planar heads beneath sheathing and decking material for the purpose of severing the nails which secure the same to an existing structure. In addition, the handles are supported from the planar heads at an angle whereby the handles may be used as a lever in order to pry shingles from a roof. However, many roofing removing tools of this type are less efficient than desired for various reasons.

Accordingly, inasmuch as the removal of sheathing and decking material is a difficult, tiring and dangerous task, a need exists for a sheathing and decking removing tool which will enable a contractor to remove the sheathing and decking material in a more efficient, less tiring and safer manner.

The present invention addresses these problems and disadvantages of the conventional method of removing sheathing and decking material in refurbishing a building.

SUMMARY OF THE INVENTION

It is an object of the present invention is to provide tool for removing sheathing and decking material and the like in an efficient and safe manner.

It is another object of the present invention to provide a tool for removing sheathing and decking material and the like with high mechanical advantage so as to allow the removal of such materials from a building construction quickly and easily, and without requiring any excessive force.

It is another object of the present invention to provide a tool for removing sheathing and decking material and the like that eliminates any muscle strain or back injury to the user of the tool which may have otherwise resulted from conventional methods and equipment.

Still another object of the present invention is to provide a tool for removing sheathing and decking material and the like which may be readily wedged beneath such material and utilized to pry such material for removal thereof from existing building structures.

Yet another object of the present invention is to provide a tool for removing sheathing and decking material and the like which is simple in construction, economical to manufacture and easy to use so as to provide a tool that will be economically feasible, long lasting and relatively trouble free in operation.

The foregoing and other objects of the present invention are carried out by a tool for removing sheathing and decking material. The tool comprises a generally wedge-shaped head having a rear end and a front end and a handle having a free end portion and a base end portion, the base end portion being integrally connected to the head with the handle free end portion projecting rearwardly from the rear end of the head. The tool further comprises a fulcrum member that removably connects to the head proximate the rear end thereof so that the fulcrum member extends in a direction transverse to the handle to provide a fulcrum during operation of the tool.

In an exemplary embodiment, the head comprises a bottom wall, a pair of opposite lateral side walls connected to and extending from opposite edges of the bottom wall, a rear wall disposed at the rear end and connected to the bottom wall and the side walls, a front wall disposed at the front end and connected to and extending between the bottom wall and the side walls, an interior space defined by the bottom, side, rear and front walls, and a support wall disposed in the interior space and extending between and connected to the side walls. The base end portion of the handle is integrally connected to the support wall.

According to preferred features of the tool, the support wall is positioned approximately midway between the rear and front walls of the head. The rear wall, the front wall and the support wall are preferably generally parallel to one another. The rear wall has an opening through which the handle extends for connection of the base end portion of the handle to the support wall of the head. Upper edges of the side walls are sloped from the rear wall downwardly towards the front wall. The side walls have a pair of aligned openings proximate the rear end of the head for receiving therethrough the fulcrum member.

According to another feature, the tool includes means for preventing relative movement between the fulcrum member and the head. In one embodiment, the means for preventing relative movement comprises a pair of depressible protrusions mounted on the fulcrum member for engagement with the respective side walls.

As another feature, the toll includes means for adjusting the position of the fulcrum member to preselected positions relative to the head in the direction transverse to the handle. In one embodiment, the means for adjusting comprises the pair of aligned openings that permit movement of the fulcrum member relative to the head in the direction transverse to the handle and a pair of depressible protrusions mounted on the fulcrum member for engagement with the side walls of the head to removably connect the fulcrum member to the head at any one of the preselected positions.

As yet another feature, the tool includes storage means for storing the fulcrum member during non-use of the tool. In one embodiment, the storage means comprises a bore of the tubular handle having an inner diameter greater than an outer diameter of the fulcrum member for receiving therein the fulcrum member, the handle having a hole communicating an exterior surface of the tubular handle with the bore thereof such that when the fulcrum member is inserted into the bore of the tubular handle, one of the depressible protrusions of the fulcrum member engages the hole of the tubular handle to removably retain and store the fulcrum member in the bore of the tubular handle.

In yet another embodiment, the handle comprises an elongated tubular member, and a weight body is disposed in the tubular member at a regions thereof including a portion of the tubular member extending through the opening of the rear wall of the head and the free end portion position of the tubular member connected to the support wall.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

Figure 1:
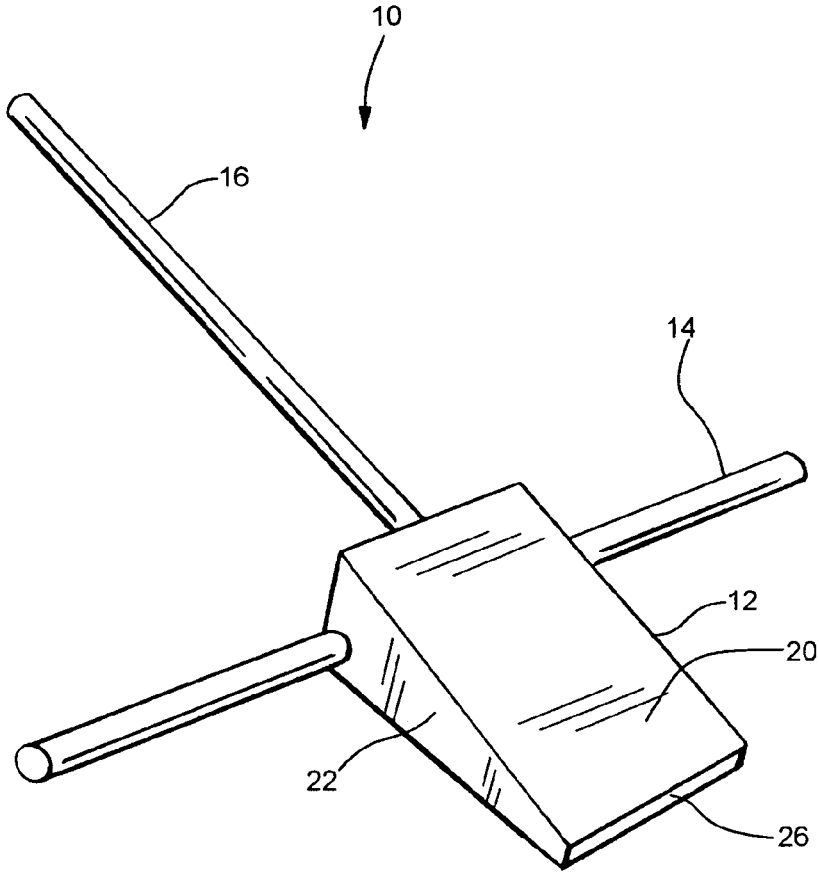
FIG. 1 is a perspective view of the tool for sheathing and decking material and the like in accordance with the present invention illustrating the orientation of the tool during use.

While this invention is susceptible of embodiments in many different forms, this specification and the accompanying drawings disclose only presently preferred embodiments of the invention. The invention is not intended to be limited to the embodiments so described, and the scope of the invention will be pointed out in the appended claims.

Certain terminology is used in the following description for convenience only and is not intended to be limiting. The words right, left, front, top, rear, back, upper, lower, inner, outer, rearwardly and forwardly designate directions in the drawing to which reference is made. Such terminology includes the words above specifically mentioned and words of similar import.

In the following description of the preferred embodiments of the present invention, the term "about" is used to quantify the preferred dimensions and weights of the tool and its components. The term "about" is defined to cover the specific dimensions and weights described as well as values within a range of ±10% of the specific dimensions and weights described.

The preferred embodiments of the tool according to the present invention is described below with a specific application to removing sheathing and decking material and the like. However, it will be appreciated by those of ordinary skill in the art that the remover of the present invention is also specifically well adapted for removal of other related or different types of flooring materials and roof covering materials (e.g., shingles, felt, tar paper), for example.

Referring now to the drawings in detail, wherein like numerals are used to indicate like elements throughout, there is shown in FIGS. 1-7 exemplary embodiments of a tool for removing sheathing and decking material and the like (hereinafter "remover"), generally designated at 10, according to the present invention. The remover 10 includes a head or pry box 12 having a side wall opening (first opening) 12*a*, a pair of aligned side wall openings (second openings) 12*b* and an upstanding reinforcing support wall 13, a fulcrum member in the form of a crossbar 14 configured for passing through the pair of side wall openings 12*b* of the pry box 12 for providing a fulcrum during use of the remover 10, and an elongated handle 16 passing through the side wall opening 12*a* of the pry box 12 and affixed at an axial end (base end portion) thereof to the support wall 13 so as to be generally transverse to the crossbar 14. In the exemplary embodiment, the handle 16 is generally perpendicular to the crossbar 14. However, it will be appreciated that other angular relationships are suitable between the crossbar 14 and the handle 16 without departing from the spirit and scope of the present invention.

The pry box 12 includes a front end, a rear end, a top end and a bottom end opposite the top end. The bottom end is closed by a bottom wall having a plurality of side walls defining an open, generally wedge-shaped box structure that is open at the top end of the pry box 12 to provide a cavity or interior space 18. More specifically, the pry box 12 includes a bottom wall 20, a pair of opposite lateral side walls 22 (left and right side walls as viewed in FIG. 2) connected or joined to and extending from opposite edges of the bottom wall 20, a rear or back wall 24 at the rear end joined to the bottom wall 18 and the lateral side walls 22, and a short front wall 26 at the front end defining a narrow shovel nose, which also extends between the bottom wall 18 and the lateral side walls 22 and which is positioned opposite the back wall 24.

Referring to FIGS. 1, 2, 4 and 5, the back wall 24 is greater in height than the front wall 26 so that upper or top edges 22*a* of the side walls 22 are sloped from the back wall 24 downwardly towards the front wall 26 to provide the pry box 2 with its wedge shape. Situated within the cavity or interior space 18 of the pry box 12 is the upstanding support wall 13 which extends between the side walls 22 and which is preferably parallel with the back wall 24 and the front wall 26. The support wall 13 is preferably positioned about midway between the back wall 24 and the front wall 26, and provides strength to the pry box 2 with minimal additional weight. The support wall 13 is integrally secured to the bottom wall 20 and the side walls 22, such as by weld 28. It is understood, however, that other forms of integral connection between the support wall 13 and the bottom wall 20 are suitable, including various types of fasteners.

Figure 2:
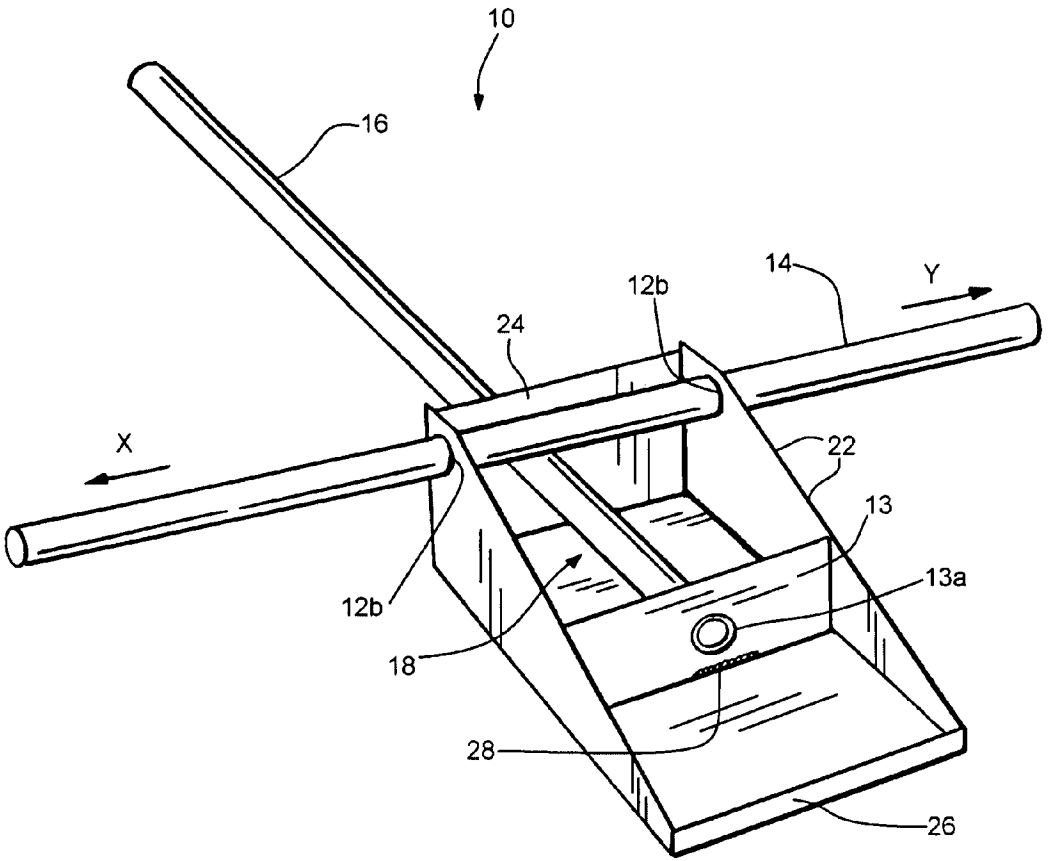
FIG. 2 is another perspective view of the tool in accordance with the present invention, with the depressible protrusions of the fulcrum member omitted for simplicity of explanation only.
Figure 3:
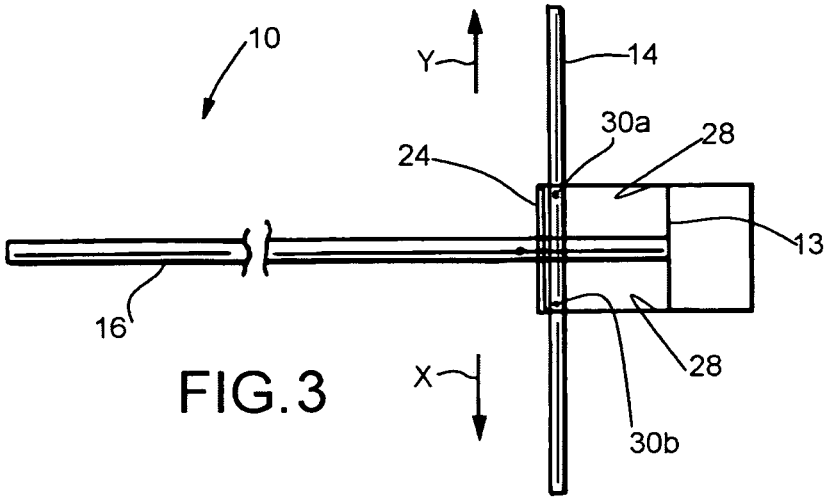
FIG. 3 is a top plan view of the tool in accordance with the present invention.
Figure 4:
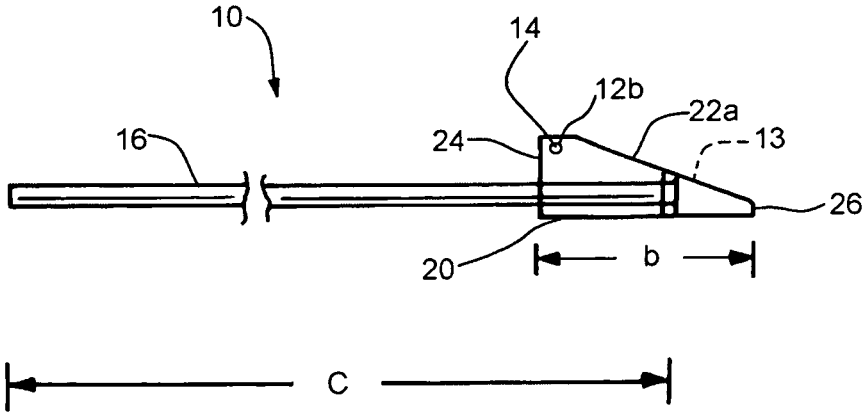
FIG. 4 is a side elevational view of the tool in accordance with the present invention.
Figure 5:
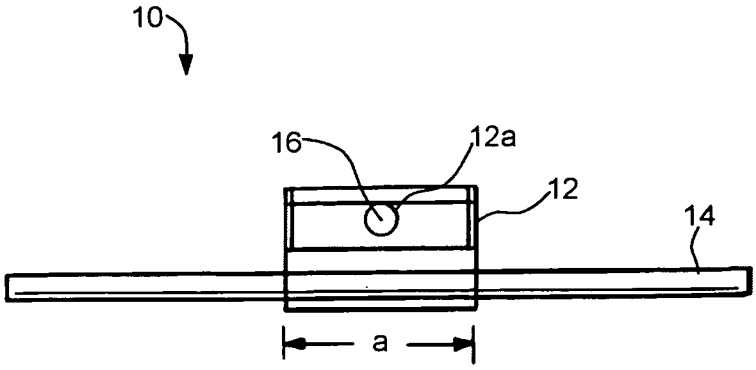
FIG. 5 is a front elevational view of the sheathing and decking remover in accordance with the present invention.

As best shown in FIGS. 2 and 4, the side wall openings 12*b* of the pry box 12 are formed through the thickness of the opposite side walls 22 and are preferably situated near or at the juncture between the side walls 22 and the back wall 24. The side wall openings 12*b* are provided in the side walls 22 to removably receive the crossbar 14 which, as shown in FIGS. 1-4, is passed through the side wall openings 12*b* and the cavity or interior space 18 of the pry box 12 to act as a fulcrum during operation of the remover as further described below. The crossbar 14 is preferably hollow and tubular in form to minimize the overall weight of the sheathing and decking remover 10, and yet is formed with a diameter and thickness which are sufficient to provide the remover with the required strength for removing sheathing and decking material from a building structure. In the exemplary embodiment, the side wall openings 12*b* of the pry box 12 are generally circular-shaped to receive therethrough the tubular crossbar 14 of similar circular-shaped cross-section. It will be appreciated, however, that other shapes and cross-sections are suitable for the side wall openings 12*b* and the tubular crossbar 14, such as oval, rectangular, triangular, hexagon, octagon, or other suitable shapes and cross-sections.

Figure 6:
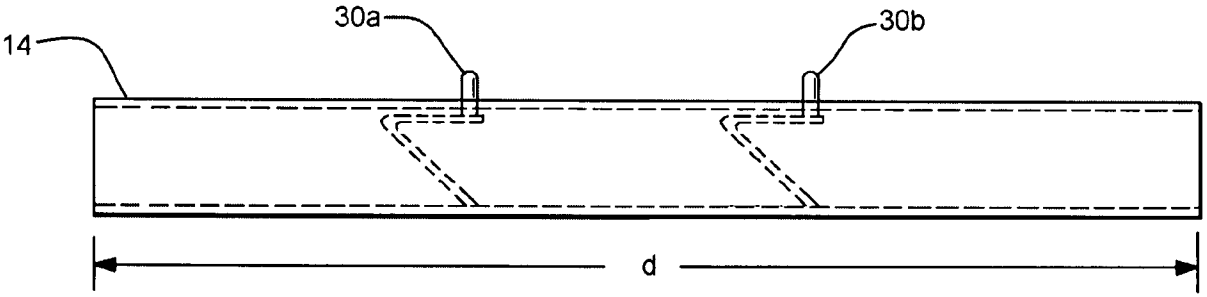
FIG. 6 is a side view of the fulcrum member of the tool in accordance with the present invention.

Referring to FIG. 6, the tubular crossbar 14 preferably includes spring loaded depressible protrusions 30*a*, 30*b* selectively projecting from the outer surface of the crossbar 14 and formed through the thickness of the crossbar and spaced apart from one another a predetermined distance which may be slightly greater than or slightly less than the width of the wedge-shaped pry box 12 so that, when the crossbar 14 is inserted into the side wall openings 12*b* of the pry box 12, the depressible protrusions 30*a*, 30*b* engage the respective side walls 22 to prevent relative lateral or transverse movement of the crossbar 14 relative to the pry box 12, as shown in FIGS. 1 and 2 (in FIG. 2 the depressible protrusions 30*a*, 30*b* have been omitted for simplicity of explanation only). Thus the depressible protrusions 30*a*, 30*b* define means for preventing movement of the crossbar 14 in the direction generally transverse to the handle 16. It will be appreciated by those skilled in the art that the means for preventing movement is not limited to spring loaded depressible protrusions. For example, cotter pins of high grade material extending through-holes formed in the crossbar 14 for engagement with the side walls 22 of the pry box 12 are also suitable for preventing movement of the crossbar 14 in the direction generally transverse to the handle 16.

The position of the crossbar 14 shown in FIGS. 1 and 2 is a first position of the crossbar 14 relative to the pry box 12. Another function of the depressible protrusions 30*a*, 30*b* is to permit adjustment of the position of the crossbar 14 in two additional positions (e.g., second and third positions, not shown) relative to the pry box 12 by displacing or moving the crossbar in left and right directions relative to the handle 16, as denoted by arrows X and Y, respectively, in FIGS. 1 and 2. For example, the second position of the crossbar 14 relative to the pry box 12 is achieved by depressing the protrusion 30*b* and displacing the crossbar 14 in the direction of arrow X until the protrusion 30*a* abuts the inner surface of the left side wall 22. The third position of the crossbar 14 relative to the pry box 12 is achieved by depressing the protrusion 30*a* and displacing the crossbar 14 in the direction of arrow Y until the protrusion 30*b* abuts the inner surface of the right side wall 22. In the second and third positions of the crossbar 14 relative to the pry box 12, the utility of the remover 10 is increased by permitting the remover to remove sheathing and decking materials from areas of a deck or sheathing which are difficult to reach (e.g., corners and/or other confined areas) in the first position of the crossbar 14 relative to the pry box 12, as shown in FIG. 1-2. Thus, the depressible protrusions 30*a*, 30*b* of the crossbar 14 and the side wall openings 12*b* of the side walls 22 define adjusting means for adjusting a position of the crossbar 14 in directions generally transverse to the handle 16 (i.e., in directions along a length or longitudinal axis of the crossbar 14). It will be appreciated by those skilled in the art, that in each of the foregoing first, second and third positions of the crossbar 14, the construction and positional relationship of the components allow for ergonomic positioning of the handle 16 and the crossbar 14 to achieve the required fulcrum during use of the remover 10.

The side wall opening 12*a* is formed through the thickness of the back wall 24 of the pry box 12. The elongated handle 16 passes through the side wall opening 12*a* and is affixed at the axial end thereof to the support wall 13 such as by welding or other integral form of connection, such by removable fasteners. The support wall 13 has an opening 13*a* that receives the axial end of the handle 16 which is secured thereto by welding, for example. The elongated handle 16 is preferably hollow and tubular in form to minimize the overall weight of the sheathing and decking remover 10, and yet is formed with a diameter and thickness which are sufficient to provide the remover with the required strength during removal of sheathing and decking material from a building structure. In the exemplary embodiment, the side wall opening 12*a* of the pry box 12 is generally circular-shaped to receive therethrough the tubular handle 16 of similar circular-shaped cross-section. It will be appreciated, however, that other shapes and cross-sections are suitable for the side wall opening 12*a* and the tubular handle 16, as described above for the side wall openings 12*b* and the tubular crossbar 14.

Figure 7:
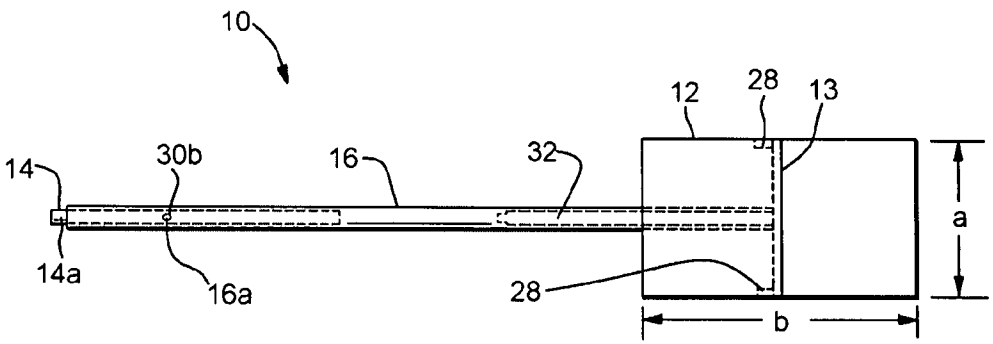
FIG. 7 is a top plan view showing modified embodiments of the tool in accordance with the present invention.

The tubular handle 16 is relatively long, that is, preferably on the order of six or seven feet, for example, to provide maximum mechanical advantage for the user of the sheathing and decking remover 10, yet not so long that the remover becomes unwieldy to handle or cumbersome to store. Preferably, as shown in FIG. 7, the outer diameter of the tubular crossbar 14 is less than the inner diameter of the tubular handle 16 so that, when the remover 10 is not being used, the crossbar 14 may be removed therefrom and stored within the bore of the tubular handle 16, thereby reducing the overall width of the sheathing and decking remover 10 and increasing the storage capability of the remover 10. In the stored configuration, the crossbar 14 is supported within the bore of the tubular handle 16 by engagement between one of the depressible protrusions 30*a*, 30*b* with an opening 16*a* of the tubular handle 16, with a portion 14*a* of the crossbar 14 extending from an axial free end (free end portion) of the tubular handle 16. In FIG. 7, the depressible protrusion 30*b* engages the opening 16*a* of the tubular handle 16. The crossbar 14 is removed from the bore of the tubular handle 16 by depressing the depressible protrusion 30*b* and pulling the crossbar 14 outwardly from the portion 14*a* of the crossbar 14. Thus the bore of the handle 16 and the engagement between the depressible protrusion 30*a* or 30*b* of the crossbar 14 and the opening 16*a* of the handle 16 define means for storing the crossbar 14 during non-use of the remover 10. By this construction and corresponding functions, the present invention provides a remover that can be stored in the bore of the handle and which is readily accessible and movable from a storage position, during non-use of the remover, to a fulcrum generating or action position ready for performing a removal operation as further described below.

FIG. 7 shows another exemplary embodiment of the sheathing and decking remover 10 according to the present invention. In this exemplary embodiment, a weight member 32 is inserted into the bore of the tubular handle 16 so as to extend to the axial end thereof that is affixed to the support wall 24 of the pry box 12. The weight body or member 32 is preferably retained within the bore of the tubular handle 16 by friction fit, or other equivalent manner, and may be solid or tubular in construction. The purpose of the weight member 32 is to add weight to the remover 10 at the area of intersection between the tubular handle 16 and the pry box 12 in order to increase the mechanical advantage during use of the remover 10 to enable a removal operation without requiring any excessive force. Preferably, the overall weight of the remover 10 is in the range of about 13 pounds to about 17 pounds, and more preferably about 15 pounds, with the weight member 32 preferably representing from about 1 pound to about 3 pounds, and more preferably 3 pounds, of the overall weight of the remover 10.

FIGS. 6-7 show preferred dimensions for the pry box 12, the crossbar 14 and the handle 16. The overall width or outer lateral dimension a of the pry box 12 is selected so that it may fit between the space provided between adjacent joists in most residential and commercial constructions. Oftentimes, joists are spaced apart twelve, sixteen or twenty-four inches on center. Therefore, the preferred outer lateral dimension of the pry box 12 of the remover 10 is preferably in the range of about 8.75 inches to 10.75 inches, and more preferably about 9.75 inches. The length b of the pry box 12 is selected in proportion to the overall width a, and is preferably in the range of about 15 inches to 17 inches, and more preferably about 16 inches. Similar concerns are taken into account when choosing the length of the tubular crossbar 14, so that the crossbar 14 may rest on at least two adjacent joists, or more joists during use. Preferably, the length c of the crossbar 14 is in the range of about 39 inches to about 41 inches, and more preferably about 40 inches. The length d of the handle 16 is selected in proportion to the foregoing selected dimensions a, b and c, and is preferably in the range of about 71 inches to 73 inches, and more preferably about 72 inches. The length of the weight member 32 is preferably in the range of about 23 inches to 25 inches, and more preferably 24 inches.

The pry box 12 is formed of sheet metal or the like and is preferably hollow to decrease the weight thereof. The sheet metal forming the pry box 12 may be formed from aluminum, such as light weight aircraft aluminum, or other material. When formed from aluminum, the pry box 12 is preferably about 0.25 inches in thickness to provide sufficient rigidity and strength to the pry box 12.

Preferably, the tubular crossbar 14 is formed of a high grade steel and the tubular handle 16 and weight member 32 are formed of aluminum. It understood, however, that other materials are suitable for the tubular crossbar 14, tubular handle 16 and weight member 32, including but not limited to titanium, and alloys of steel, aluminum and titanium.

During an operation of the remover 10 to remove sheathing, decking or the like from a building construction, the handle 16 is manipulated by an operator to position the remover 10 such that the wedge-shaped pry box 12, in the orientation shown in FIG. 1, is situated between adjacent joists supporting the deck or sheathing with the crossbar 14 being oriented perpendicularly to the running direction of the joints and resting on the surface of the joists which support the sheathing or decking. The front wall 26 (i.e., the narrow shovel nose) of the wedge-shaped pry box 12 is inserted at an angle underneath the sheathing or decking to be removed, with the handle 16 being disposed in a raised, angular position with respect to the plane in which the decking or sheathing resides. The operator then pushes down on the axial free end of the handle 16 opposite the wedge-shaped pry box 12 to cause the pry box 12 to pivot upwardly against the bottom of the sheathing or decking attached to the joists, with the crossbar 14 acting as a fulcrum. The wedge-shaped box 12 forces the sheathing or decking to lift off the supporting joists on which it is attached. The remover 10 is then advanced on the spaced apart joists to the next adjacent sheathing or decking, and the lifting operation is repeated. Preferably, the remover is then repositioned between the next adjacent pair of joists and the operation is repeated until all of the sheathing or decking has been removed.

The remover of the present invention, because of the mechanical advantage it provides and its construction, removes sheathing and decking and like materials from a building construction quickly and easily, and without requiring any excessive force. In particular, by providing the pry box with a front wall forming a narrow shovel nose, the remover can effectively be inserted into tight and narrow spots requiring removal of sheathing and decking material and the like. Thus, the sheathing and decking remover of the present invention minimizes or eliminates any muscle strain or back injury to the user of the remover which may have otherwise resulted from conventional methods and equipment. Removal of sheathing and decking material and the like using the remover of the present invention requires less time and lowers construction costs as compared to the conventional methods and equipment.

While the present invention has been described in terms of specific embodiments, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

We claim:

1. A tool for removing sheathing and decking material, the tool comprising:

a generally wedge-shaped head having a rear end and a front end;

a handle having a free end portion and a base end portion, the base end portion being integrally connected to the head with the handle free end portion projecting rearwardly from the rear end of the head;

a fulcrum member that removably connects to the head proximate the rear end thereof so that the fulcrum member extends in a direction transverse to the handle to provide a fulcrum during operation of the tool; and means for storing the fulcrum member;

wherein the head comprises a bottom wall, a pair of opposite lateral side walls connected to and extending from opposite edges of the bottom wall, a rear wall disposed at the rear end and connected to the bottom wall and the side walls, a front wall disposed at the front end and connected to and extending between the bottom wall and the side walls, an interior space defined by the bottom, side, rear and front walls, and a support wall disposed in the interior space and extending between and connected to the side walls, the base end portion of the handle being integrally connected to the support wall; and wherein the side walls have a pair of aligned openings proximate the rear end of the head for receiving therethrough the fulcrum member.

2. A tool according to claim 1; wherein the support wall is positioned approximately midway between the rear and front walls of the head.

3. A tool according to claim 1; wherein the rear wall, the front wall and the support wall are generally parallel to one another.

4. A tool according to claim 1; wherein the rear wall has an opening through which the handle extends for connection of the base end portion of the handle to the support wall of the head.

5. A tool according to claim 1; wherein upper edges of the side walls are sloped from the rear wall downwardly towards the front wall.

6. A tool according to claim 1; further comprising means for preventing relative movement between the fulcrum member and the head.

7. A tool according to claim 6; wherein the means for preventing relative movement comprises a pair of depressible protrusions mounted on the fulcrum member for engagement with the respective side walls.

8. A tool according to claim 1; further comprising means for adjusting the position of the fulcrum member to preselected positions relative to the head in the direction transverse to the handle.

9. A tool according to claim 8; wherein the means for adjusting comprises the pair of aligned openings that permit movement of the fulcrum member relative to the head in the direction transverse to the handle and a pair of depressible protrusions mounted on the fulcrum member for engagement with the side walls of the head to removably connect the fulcrum member to the head at any one of the preselected positions.

10. A tool according to claim 1; wherein the head is formed of sheet metal.

11. A tool according to claim 1; wherein the handle comprises an elongated tubular member; and further comprising a weight body disposed in the tubular member at a regions thereof including a portion of the tubular member extending through the opening of the rear wall of the head and the free end portion position of the tubular member connected to the support wall.

12. A tool according to claim 1; wherein the handle is tubular in construction; wherein the fulcrum member has a pair of depressible protrusions for engagement with the side walls of the head to removably connect the fulcrum member to the head at any one of preselected positions relative to the head in the direction transverse to the handle; and wherein the means for storing comprises a bore of the tubular handle having an inner diameter greater than an outer diameter of the fulcrum member for receiving therein the fulcrum member, the handle having a hole communicating an exterior surface of the tubular handle with the bore thereof such that when the fulcrum member is inserted into the bore of the tubular handle, one of the pair of depressible protrusions of the fulcrum member engages the hole of the tubular handle to removably retain and store the fulcrum member in the bore of the tubular handle.

13. A tool according to claim 1; wherein the wedge-shaped head has a top end and a bottom end opposite the top end; and wherein the bottom end is closed by the bottom wall from which the lateral side walls, rear wall, and front wall extend to form the wedge-shaped head as an open box structure that is open at the top end.

14. A tool for removing sheathing and decking material, the tool comprising:

a head having a front end, a rear end, a top end and a bottom end opposite the top end, the bottom end being closed by a bottom wall having a plurality of side walls defining an open, generally wedge-shaped box structure that is open at the top end, the plurality of side walls including a pair of opposite lateral side walls connected to and extending from opposite edges of the bottom wall, a rear wall disposed at the rear end and connected to the bottom wall and the side walls, and a front wall disposed at the front end and connected to and extending between the bottom wall and the side to provide an interior space defined by the bottom, side, rear and front walls, upper edges of the side walls sloping from the rear wall downwardly towards the front wall;

a support wall disposed in the interior space of the head and extending between and connected at opposite edges thereof to the side walls of the head;

a tubular handle having a bore, a hole communicating an exterior surface of the handle with the bore, a free end portion and a base end portion, the base end portion being integrally connected to the support wall of the head with the handle free end portion projecting rearwardly from the rear end of the head; and a tubular fulcrum member that removably connects to the head proximate the rear end thereof so that the fulcrum member extends in a direction transverse to the handle to provide a fulcrum during operation of the tool, the fulcrum member being configured to be removably received and stored in the bore of the handle during non-use of the tool, and the fulcrum member having at least one depressible protrusion such that when the fulcrum member is stored in the bore of the handle, the depressible protrusion engages the hole of the handle to removably retain the fulcrum member in the bore of the handle.

15. A tool according to claim 14; wherein the support wall is positioned approximately midway between the rear and front walls of the head; and wherein the rear wall, the front wall and the support walls are generally parallel to one another.

16. A tool according to claim 14; wherein the rear wall of the head has an opening through which the handle extends for connection of the base end portion of the handle to the support wall of the head; and wherein the side walls of the head have a pair of aligned openings proximate the rear end of the head for receiving therethrough the fulcrum member.

17. A tool according to claim 14; wherein the at least one depressible protrusion comprises a pair of depressible protrusions.

18. A tool according to claim 17; wherein the pair of depressible protrusions are configured to engage the respective side walls of the head to prevent relative movement between the fulcrum member and the head during operation of the tool.

19. A tool for removing sheathing and decking material, the tool comprising:

a head having a rear end, front end, a bottom wall, a pair of opposite lateral side walls connected to and extending from opposite edges of the bottom wall, a rear wall disposed at the rear end and connected to the bottom wall and the side walls, a front wall disposed at the front end and connected to and extending between the bottom wall and the side walls, an interior space defined by the bottom, side, rear and front walls, and a support wall disposed in the interior space and extending between and connected at opposite edges thereof to the side walls, upper edges of the side walls sloping from the rear wall downwardly towards the front wall;

a handle having a free end portion and a base end portion, the base end portion being integrally connected to the support wall of the head with the handle free end portion projecting rearwardly from the rear end of the head; and a fulcrum member that removably connects to the head proximate the rear end thereof so that the fulcrum member extends in a direction transverse to the handle to provide a fulcrum during operation of the tool, the fulcrum member having a pair of depressible protrusions for engagement with the respective side walls of the head to prevent relative movement between the fulcrum member and the head during operation of the tool, the depressible protrusions, upon being depressed, allowing the fulcrum member to be displaced in the direction transverse to the handle for positioning the fulcrum member to preselected positions along the transverse direction;

wherein each of the handle and the fulcrum member is tubular in construction, the handle having a bore with an inner diameter greater than an outer diameter of the fulcrum member for receiving and storing therein the fulcrum member during non-use of the tool, the handle having a hole communicating an exterior surface of the handle with the bore thereof such that when the fulcrum member is stored in the bore of the handle, one of the pair of depressible protrusions of the fulcrum member engages the hole of the tubular handle to removably retain the fulcrum member in the bore of the handle.

20. A tool according to claim 19; wherein the wedge-shaped head has a top end and a bottom end opposite the top end; and wherein the bottom end is closed by the bottom wall from which the lateral side walls, rear wall, and front wall extend to form the wedge-shaped head as an open box structure that is open at the top end.

* * * * *